US007954748B2

(12) United States Patent
Weissbrod

(10) Patent No.: US 7,954,748 B2
(45) Date of Patent: Jun. 7, 2011

(54) SPOOL FOR RETAINING WIRE

(75) Inventor: Paul A. Weissbrod, South Euclid, OH (US)

(73) Assignee: Lincoln Global, Inc., City of Industry, CA (US)

( * ) Notice: Subject to any disclaimer, the term of this patent is extended or adjusted under 35 U.S.C. 154(b) by 11 days.

(21) Appl. No.: 11/870,774

(22) Filed: Oct. 11, 2007

(65) Prior Publication Data

US 2009/0095834 A1 Apr. 16, 2009

(51) Int. Cl.
*B65H 75/28* (2006.01)

(52) U.S. Cl. ..... 242/580; 242/614; 242/125.2

(58) Field of Classification Search ..... 242/580, 242/125.2, 587, 587.2, 614, 125, 125.1, 476.1, 242/476.6, 579
See application file for complete search history.

(56) References Cited

U.S. PATENT DOCUMENTS

| | | | | |
|---|---|---|---|---|
| 2,374,111 | A * | 4/1945 | Le Tourneau | 242/587 |
| 2,583,933 | A | 1/1952 | Elder | |
| 3,942,741 | A | 3/1976 | Hussar et al. | |
| 4,387,863 | A * | 6/1983 | Edmonston et al. | 242/118.4 |
| 4,602,751 | A | 7/1986 | Vogel | |
| 4,938,432 | A * | 7/1990 | Kurt et al. | 242/580 |
| 5,236,145 | A * | 8/1993 | Floury et al. | 242/603 |
| 5,379,965 | A * | 1/1995 | Isler et al. | 242/586.6 |
| 5,931,408 | A | 8/1999 | Ishii et al. | |
| 6,047,918 | A * | 4/2000 | Saito | 242/580 |
| 6,715,710 | B1 | 4/2004 | Russell et al. | |
| 7,137,587 | B2 * | 11/2006 | Jeong et al. | 242/609.1 |
| 7,222,818 | B2 | 5/2007 | Couchey et al. | |
| 2004/0108407 | A1 * | 6/2004 | Jeong et al. | 242/587 |

FOREIGN PATENT DOCUMENTS

| | | | |
|---|---|---|---|
| DE | 9115063 | U1 | 4/1993 |
| FR | 2531688 | A1 | 2/1984 |
| JP | 0826603 | | 1/1996 |
| JP | 09070835 | | 3/1997 |
| JP | 10034337 | A | 2/1998 |
| JP | 2001163527 | A | 6/2001 |
| WO | 2004099053 | A2 | 11/2004 |

OTHER PUBLICATIONS

PCT/IB2008/002648 International Search report, Aug. 6, 2009.
PCT/IB2008/002648 Written Opinion, Apr. 11, 2010.
PCT/IB2008/002648 International Preliminary Report on Patentability, Apr. 11, 2010.

* cited by examiner

*Primary Examiner* — William E Dondero
(74) *Attorney, Agent, or Firm* — Hahn Loeser & Parks LLP

(57) ABSTRACT

A spool or reel for retaining continuously wound material may include a central barrel and spaced apart flange members extending from the central barrel. The flange members may incorporate a retaining member comprising the curved channel terminating at the first and second holes fashioned in an inner face of the flange members. The flange members may also incorporate one or more holes or apertures for use with associated sensors where the holes or apertures include a rim to circumference for easy detection by the associated sensors. The flange members may further comprise label platforms that securely receive labels that are to be affixed to the spool or reel.

18 Claims, 7 Drawing Sheets

SPOOL FOR RETAINING WIRE

TECHNICAL FIELD

The present invention pertains to spools for storing and dispensing wire and more particularly, to spools used to retain welding wire.

BACKGROUND OF THE INVENTION

Spools or reels are well known for transporting and storing bulk wire, cable and/or other wound material such as welding wire, electrical wire, bailing wire, and the like. A typical spool comprises a pair of spaced apart disc-shaped flanges joined by a central barrel. Wire or cable is spirally wound around the central barrel between the spaced flanges until the spool is filled with the appropriate amount of material. Filled spools can then be stacked atop one another for shipment, storage and subsequent use. When it is desired to dispense the wire or cable, it may be pulled progressively from the spool, which may be mounted on an arbor or spindle to rotate and thus pay out the wound material. If only a portion of the wire or cable is used, the free end of the remaining portion may be secured to one of the flanges of the reel, whereupon the spool can be stored for future use.

Welding wire is one type of material that may be wound on to and dispensed from a spool. The spool is typically placed onto the arbor of a wire feeder where the coiled wire is fed to a drive motor and subsequently to a welding gun. One example of a welding process using spools in this manner may include Gas-Metal-Arc-Welding (GMAW). The welding wire or electrode may be continuously fed to the workpiece until the spool has been depleted of welding wire.

One aspect in the use of spools to retain welding wire relates to how the product is identified. Welding wire requires proper labeling to identify not only the type of material included therein but also to identify product usage warnings. It is important for any label once applied to remain in place until all of the welding wire has been dispensed from the spool. Many labels applied to spools become dislodged from the surface of the spool to which they are applied and/or their edges frayed, making them susceptible to peeling. What is needed is a spool having a delineated area for receiving one or more labels that helps the labels stay in place once applied.

Another aspect of welding wire spools pertains to how the welding wire is secured to the spool when not in use. Coiled welding wire has memory and a tendency to unravel when not secured or grounded to the spool or wire feeder. In some applications, welding wire is routed through holes in the spool to retain an end of the welding wire. However, the wire frequently pulls free from the holes in the spool thereby inadvertently unraveling, which may contact other welding components connected to the welding power supply. What is needed is an economical and reliable way to retain welding wire wound on the spools when not in use.

Still another aspect of welding wire spools relates to the strength of the spool components. Plastics have become commonplace for the construction of articles like spools or reels. However, the manufacture of plastic spools by conventional forming techniques is complex and many of the currently available low-cost plastic spools are deficient in strength and durability. Higher strength plastic spools, on the other hand, frequently contain additional plastic material making them heavier and more expensive. What is needed is a spool design that minimizes the amount of material used in constructing the spool.

Advancements in manufacturing have led to the increased use of automated technology. These advancements frequently utilize sensors that detect the presence and/or position of products used in the manufacturing process. Such use of sensors is also applied to the winding of welding wire on to spools. However, consistent and reliable data fed back from the sensors is necessary to ensure quality. This in part may be related to the construction of the spool itself. What is needed is a spool that can be used in conjunction with sensor technology to feedback reliable information used to control quality in the manufacturing process.

The embodiments of the subject invention obviate the aforementioned problems of currently available spools used in the marketplace today.

BRIEF SUMMARY

In one embodiment of the subject invention a spool for retaining wire includes a barrel having an outer face for receiving associated wire, and at least a first flange extending from the barrel for retaining the associated wire on the barrel, wherein the at least a first flange includes a curved channel for circuitously routing an end of the associated wire.

In one aspect of the embodiments of the subject invention the curved channel is concave with respect to a plane perpendicular to the outer face of the barrel.

In another aspect of the embodiments of the subject invention the at least a first flange includes an inner flange face, wherein the spool may further comprise a first and at least a second hole fashioned in the inner flange face and wherein the first and at least a second hole define ends of the curved channel.

In yet another aspect of the embodiments of the subject invention a centerline axis of the first hole, and also potentially the at least a second hole, forms an acute angle with the surface of the inner flange face. The acute angle may be substantially in the range between 50 and 85° and more specifically may be 25°.

In still another aspect of the embodiments of the subject invention the at least a first flange has a thickness T where the diameter of the first and the at least a second hole may be smaller than the thickness T of the at least a first flange. The curved channel may be fashioned in an outer flange face of the at least a first flange such that when the wire is routed through the curved channel, the wire does not extend beyond or outside the outer flange face.

In another embodiment of the subject invention a welding wire retaining device, may comprise a barrel for receiving welding wire, at least a first flange extending from the barrel, the at least a first flange having an outer flange face, and a label platform or label base fashioned in the outer flange face for receiving an associated label.

In one aspect of the embodiments of the subject invention the label base may comprise a ledge configured to match the circumference of the associated label, wherein the label base may be either raised or recessed with respect to at least a first portion of the outer flange face.

In still another aspect of the embodiments of the subject invention the label base may include a continuously formed surface, which may be substantially smooth and uniform, having a circumference that substantially matches the circumference of the associated label.

In yet another aspect of the embodiments of the subject invention multiple label bases may be fashioned in the outer flange face for receiving multiple associated labels respectively.

In another embodiment of the subject invention a spool for retaining welding wire may include a barrel, at least a first flange extending from the barrel, where the at least a first flange comprises a first raised portion and a second recessed portion, and a beveled transition region extended between the first raised portion and the second recessed portion.

Even another embodiment of the subject invention includes a welding wire spool that comprises a barrel for receiving associated welding wire, at least a first flange extending from the barrel, at least a first cavity fashioned in the at least a first flange for use with an associated sensor in determining the position of the welding wire spool, and a rim extending from the at least a first flange and encircling the at least a first cavity.

In one aspect of the embodiments of the subject invention the rim has a width W that is substantially uniform around the entire circumference of the rim, where the width may be in the range of 0.1 inch to 0.25 inch.

DETAILED DESCRIPTION OF THE INVENTION

Figure 1:
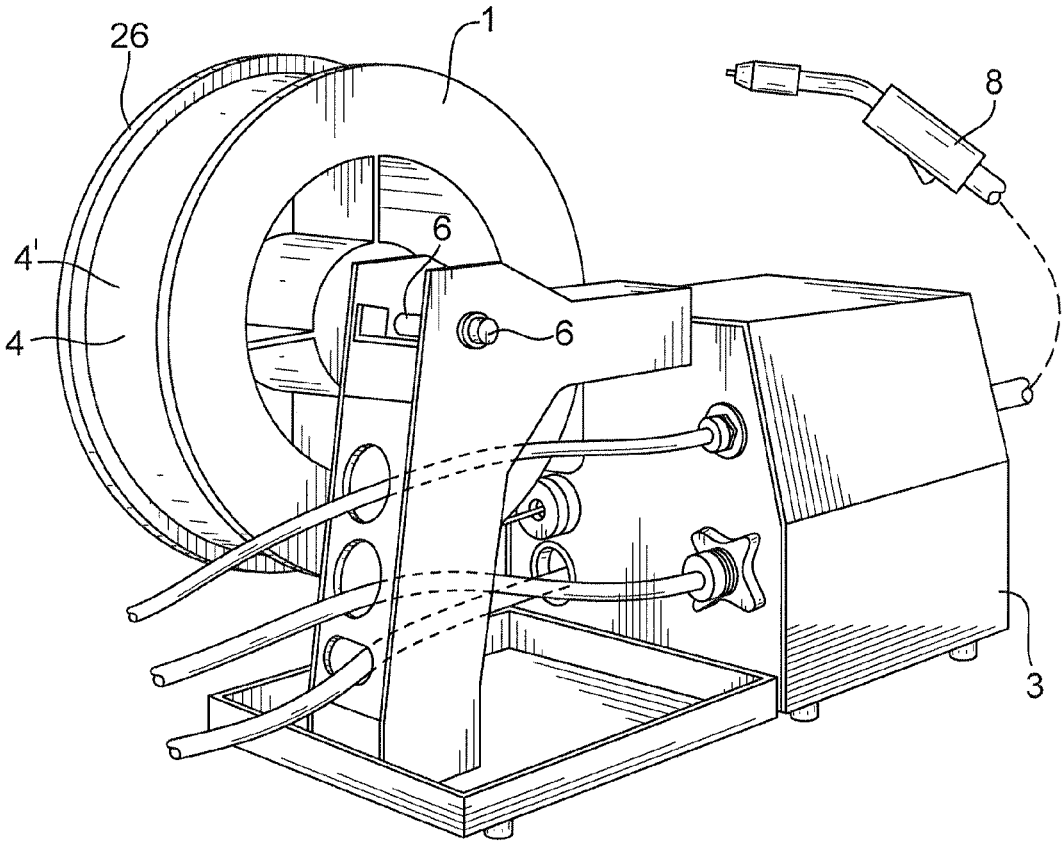
FIG. 1 is a perspective view of a spool and wire feeder according to the embodiments of the subject invention.

Referring now to the drawings wherein the showings are for purposes of illustrating embodiments of the invention only and not for purposes of limiting the same, FIG. 1 shows a spool or reel depicted generally at 1. The spool 1 may be used to retain contiguously formed material, such as for example wire 4. In one embodiment, the wire 4 may be welding wire 4'. As such, spool 1 is exemplified as a welding wire spool 1 and may be used in conjunction with a welding power supply, not shown, and a wire feeder 3. The wire 4 or welding wire 4' retained on the spool 1 may be continuously fed to a welding gun 8 through a wire feeder 3 as is well known in the art. In particular, the welding wire 4' may be welding filler wire 4' or welding cored wire 4'. However it is to be construed that the spool 1 may be used to retain any type of material including but not limited to: electrical wire, cables, thread and the like. The spool 1 may include an aperture 5 for receiving an arbor 6 or other axial member 6 on which the spool 1 may rotate as wire 4 is being wound thereon or dispensed therefrom.

Figure 2:
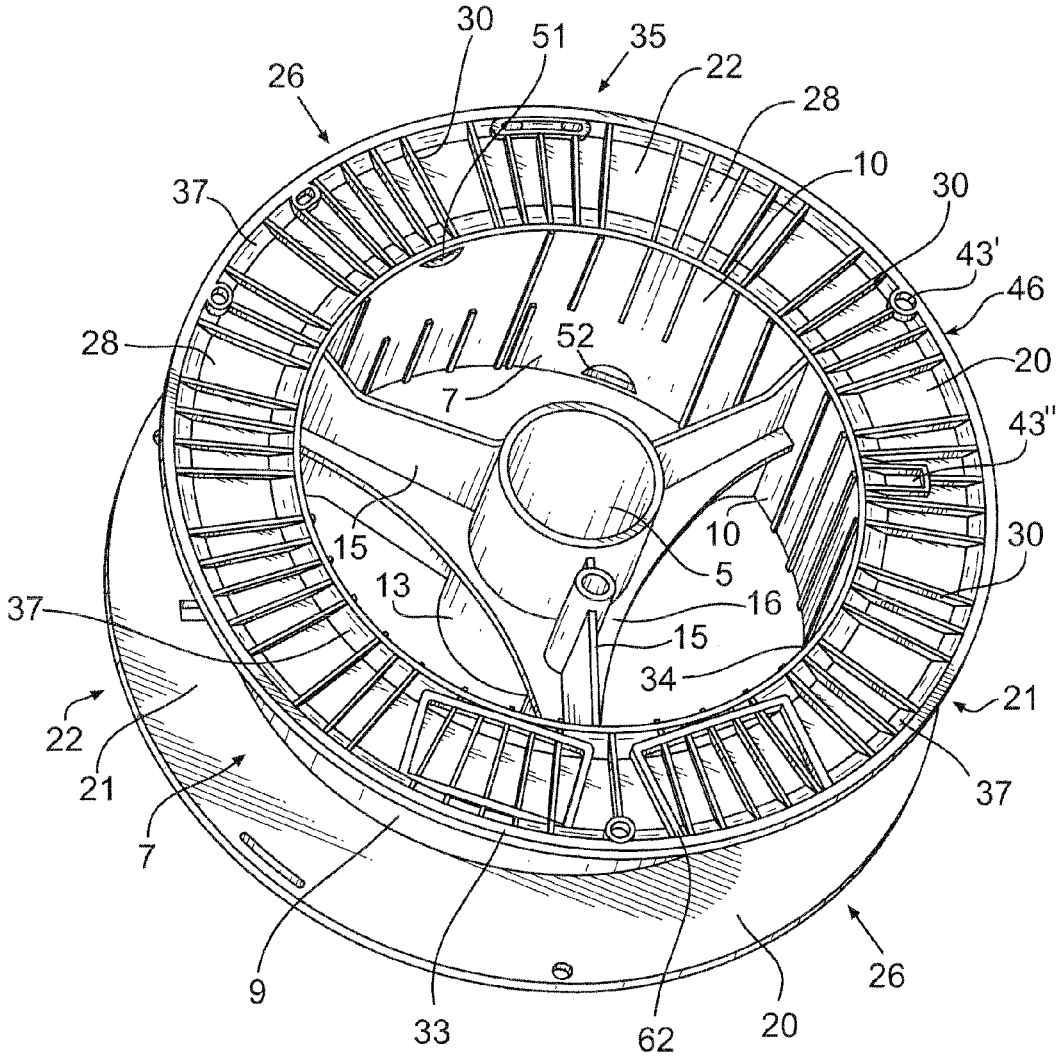
FIG. 2 is a perspective view of a spool according to the embodiments of the subject invention.

With continued reference to FIG. 1 and now to FIG. 2, the spool 1 may include a barrel 7, which may be generally cylindrical in configuration. Although other configurations of the barrel 7 may be chosen without limiting the intended scope of coverage of the embodiments of the subject invention. The barrel 7 may include an outer surface 9 characterized by an outer diameter D, on which the material or wire 4 may be wound and dispensed as discussed above. The outer diameter D may be in the range of 8 to 14 inches. More specifically, the outer diameter D may be between 10 to 12 inches. Still, persons of ordinary skill in the art will understand the application of the embodiments of the subject invention to any size spool 1 or barrel diameter D. Positioned within an interior region of the outer surface 9, the spool 1 may include a tubular member 13 having an aperture 5 fashioned therein to receive an arbor 6 as previously mentioned. In one embodiment, the tubular member 13 may be fixedly connected to the barrel 7 by way of spokes 15 or radial arms 15. The distal ends of the radial arms 15 may be affixed with respect to an inner surface 10 of the barrel 7. Each of the radial arms 15 may be reinforced by gussets 16 to prevent twisting and provide added rigidity to the spool 1 when loaded with material. The spool 1 is illustrated as having three (3) radial arms 15. However, any number of radial arms 15 may be utilized as chosen with sound engineering judgment. It is noted that the radial arms 15 and gussets 16 may minimize the amount of material used in constructing the spool 1 thereby minimizing its weight.

With continued reference to FIG. 2, the spool 1 may also include one or more flanges 20 that comprise side walls for retaining the wire 4 on the spool 1. In one embodiment, the spool 1 may include first and second flanges 20 that extend radially outward from the barrel 7. The first and second flanges 20 may extend substantially perpendicular with respect to the outer surface 9 of the barrel 7. However, it is contemplated in an alternate embodiment that one or both of the first and second flanges 20 may form an acute angle with respect to a perpendicular axis of the outer surface 9 of the barrel 7. The first and second flanges 20 may also be laterally positioned at distal ends of the barrel 7. In this manner, the contour of the first and second flanges 20 and the barrel 7 may form a U-shaped channel. Accordingly, each of the first and second flanges 20 may include an inner flange face 21 for contacting the wire 4 and an outer flange face 22. As such, the cross section of the inner flange faces 21 and outer surface 9 of the barrel 7 may be convex with respect to an axis of rotation of the spool 1. The height of the first and/or second flanges 20 may be in the range of 0.5 to 5 inches above the outer surface 9 of the barrel 7. However, it is to be construed that any dimensional height of the first and second flanges 20, and any width W or outer diameter D of the barrel 7 may be chosen as is appropriate for use with the embodiments of the subject invention.

With continued reference to FIGS. 1 and 2, the thickness of a flange 20 may be in the range of 0.15 inch to 0.25 inch, and more specifically in the range of 0.18 inch to 0.20 inch. Additionally, the outer flange face 22 may be constructed having a plurality of recesses 28 radially fashioned within the outer flange face 22, which may be useful in reducing the weight and the amount of material needed to construct the spool 1. The recesses 28 may be interposed between radially extending ribs 30. In one embodiment, the thickness of the flange 20 at a position within the recesses 28 may be in the range of 0.075 inch to 0.125 inch. However, any thickness of the recesses 28 may be chosen in accordance with the type of material used to construct the spool 1 and/or components of the spool 1. A flange rim 26 may be defined as that portion on the outer flange face 22 that circumferentially bounds the recesses 28. Accordingly, the outer flange face 22 may include an outer flange rim portion 33 and an inner flange rim portion 34. The outer flange rim portion 33 and the inner flange rim portion 34 may have a thickness corresponding to the difference between the overall thickness of the flange 20 and the recesses 28. In other words, the thickness of the flange rims 26 may range between substantially 0.075 inch and 0.125 inch. In the current embodiment, the outer flange rim portion 33 and the inner flange rim portion 34 are exemplified as having substantially the same thickness. However, other embodiments are contemplated where each of the flange rims may have different thicknesses. As illustrated in the figures, holes or cavities may be fashioned in the flange rims 26, which may be used in the process of winding wire 4 onto the spool 1 as will be discussed in detail below.

The transition region 37 between the flange rim portions 33, 34 and the recesses 28 may include a gradual transition, which may for example be sloped or curved, thereby eliminating a step between the two sections of the flange 20. In one embodiment, the transition region 37 may be chamfered or beveled. In an alternate embodiment, the transition region 37 may be curved in either a concave or convex fashion. However, any configuration of transition region 37 may be utilized without limiting the scope of coverage of the embodiments of the subject invention. It should be realized that the transition region 37 may strengthen and add rigidity to the spool 1 and more particularly to the flanges 20 thereby enabling the spool 1 to withstand greater torsional forces when loaded with wire 4. Accordingly, any angle, contour and/or length of transition region 37 may be chosen as is appropriate for use with the embodiments of the subject invention.

Figure 3A:
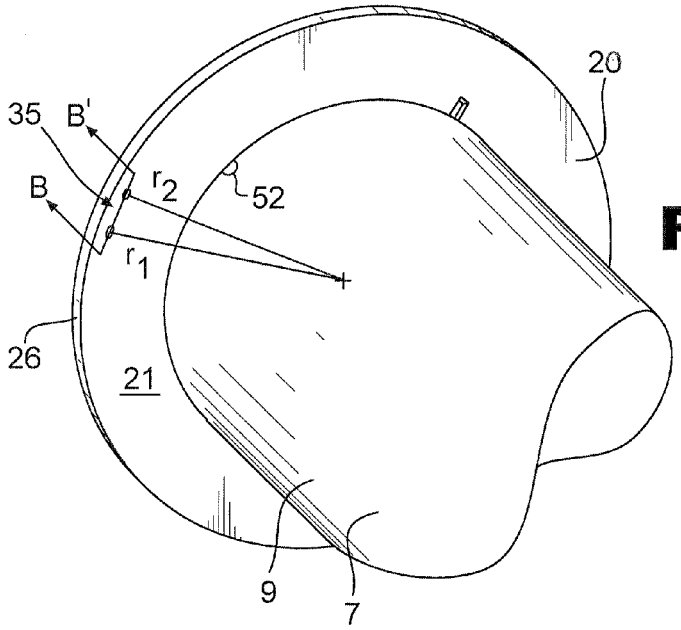
FIG. 3*a* is a partial cutaway perspective view of the interior of the spool according to the embodiments of the subject invention.
Figure 3:
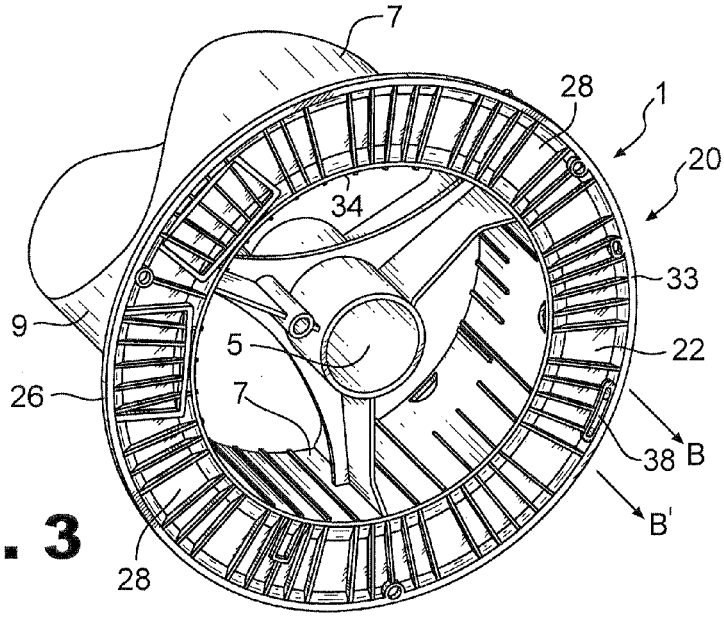
FIG. 3 is a partial cutaway perspective view of the exterior of the spool according to the embodiments of the subject invention.
Figure 3B:
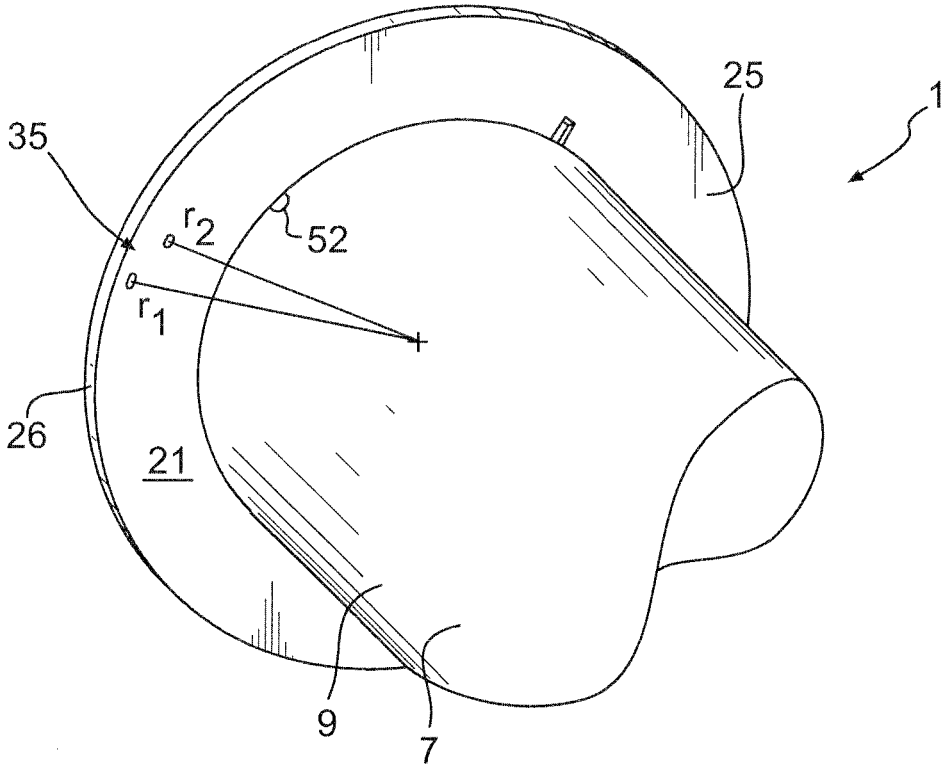
FIG. 3*b* is a partial cutaway perspective view of the interior of the spool according to the embodiments of the subject invention.
Figure 5:
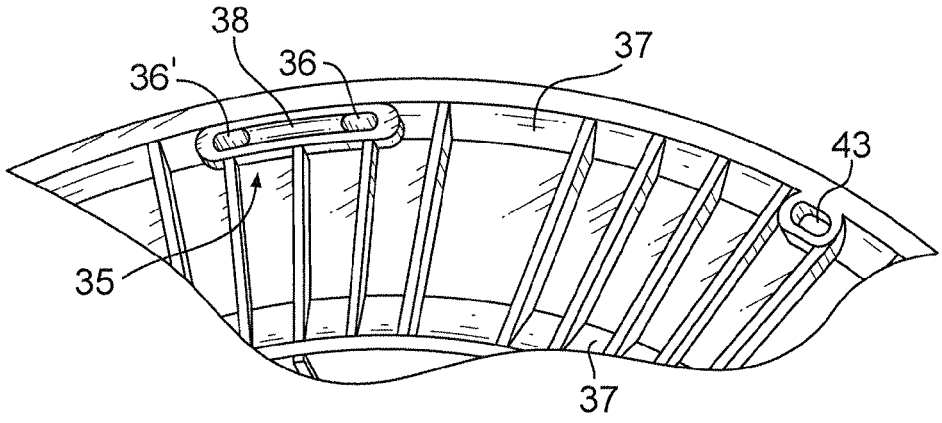
FIG. 5 is a close-up cutaway view of a first portion of the spool according to the embodiments of the subject invention.

With continued reference to FIG. 2 and now to FIGS. 3, 3*a* and 5, the spool 1 may include a retaining member 35. The retaining member 35 may be used to hold an end of the wire 4 in place when it is not being dispensed from the spool 1. In this manner, the wire 4 may not be inadvertently unraveled from the spool 1, but rather held in place until intentionally removed by an operator. The retaining member 35 may be integrally fashioned into a surface of the spool 1. More specifically, the retaining member 35 may be fashioned into at least one of the first and second flanges 20. In one embodiment, the retaining member 35 may not comprise moving parts. Rather holes 36 may be fashioned in the inner flange face 21 of at least one of the first and second flanges 20. A channel 38 may connect the holes 36, which may be first and second holes 36, 36', thereby forming a circuitous route for receiving and retaining the wire 4 in place. The first and second holes 36, 36' may extend from the inner flange face 21 and through the body of the flange 20. Accordingly, the channel 38 may be fashioned on an outer flange face 22 but may be surrounded by a rimmed portion of material 40 for protecting the wire 4 from contact with other objects. The channel 38 may be curved having a contoured surface that comprises the circuitous route for holding the wire 4 in place. In the current embodiment, the contoured surface of the channel 38 may be generally concave with respect to the inner flange face 21. In other words, the contoured surface of the channel 38 may include at least a first raised portion 42. It is noted here that routing the wire 4 in this manner increases frictional resistance between the wire 4 and the surface of the spool 1 thereby holding the wire 4 in place without the use of moving parts. It is to be construed that any radius of curvature or contour of the channel 38 may be chosen as is appropriate for use with the embodiments of the subject invention.

Figure 4:
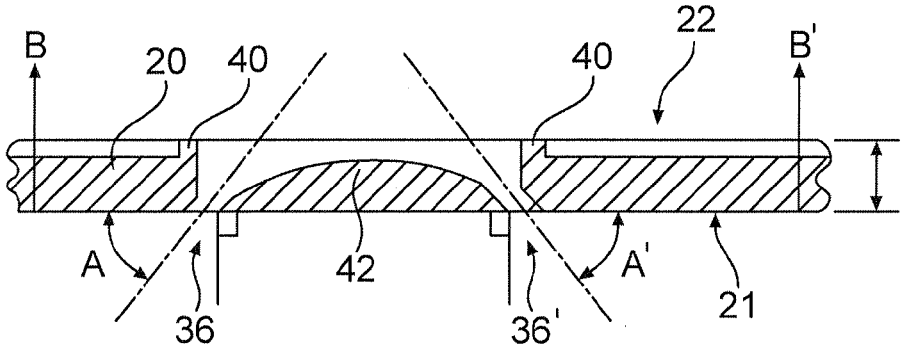
FIG. 4 is a cross sectional view of the flange of the spool according to the embodiments of the subject invention.

With reference now to FIG. 4, each of the first and second holes 36, 36' may be fashioned at angles with respect to the inner flange face 21. By fashioned at angles, it is meant that a centerline axis of the holes 36 forms an acute angle with respect to the surface of the inner flange face 21. The acute angle may be substantially in the range between 0° and 90°. In one embodiment, the acute angle may be substantially 90°. However, it is to be construed that the first and second holes 36, 36' may be fashioned at any angle and/or at any orientation with respect to the channel 38. Additionally, each of the first and second holes 36, 36' may be fashioned at substantially the same radius with respect to a center point of the flange 20 shown in FIG. 3*a*. Other embodiments are contemplated where the first and second holes 36, 36' may have substantially different radii. In fact, any radii defining the position of the first and second holes 36, 36' may be chosen with sound engineering judgment. Persons of ordinary skill in the art will readily see that the position of the first hole with respect to the second hole will set the length and angular orientation of the curved channel 38. Accordingly, any length and/or orientation of the curved channel 38 may be chosen as is appropriate for use with the embodiments of the subject invention.

The diameter of the first and second holes 36, 36' may be slightly larger than the diameter of the wire 4 retained on the spool 1. In an exemplary manner, which should not be construed as limiting, the diameter of the wire 4 may be 0.052 inch. Accordingly, the diameter of the first and second holes 36, 36' may be 0.075 inch. However, the diameter of the first and second holes 36, 36' may also be 0.125 inch for use in accommodating larger diameter wires 4. In fact, any diameter of the first and second holes 36, 36' may be chosen in accordance with the size and type of wire 4 to be retained on the spool 1. It is noted here that the thickness of the flange 20 may be larger than the diameter of the wire 4 and, more specifically, larger than the diameter of the first and second holes 36, 36'. It is to be understood that wire diameters greater than the thickness of the flange 20 will cause wire 4 routed through the channel 38 to extend beyond the outer flange face 22 thereby exposing the wire 4 to damage and/or unwanted contact with other objects. Accordingly, the depth of the channel 38 and the thickness of the flange 20 may be chosen such that wire 4 received in the channel 38 may be recessed with respect to the outer flange face 22.

Figure 4A:
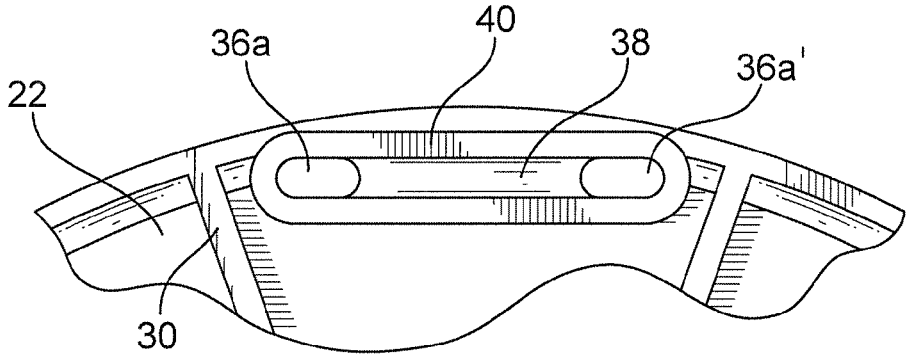
FIG. 4*a* is a close up side view of the flange of the spool according to the embodiments of the subject invention.
Figure 4B:
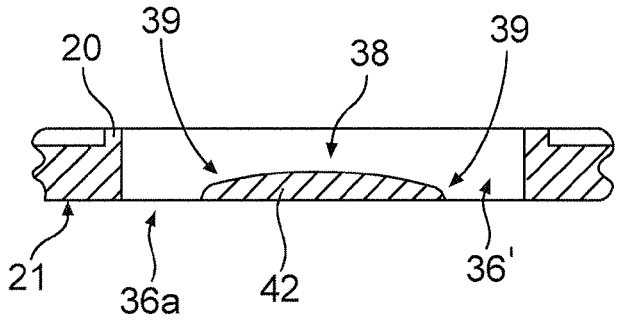
FIG. 4*b* is a cross sectional view of the flange of the spool according to the embodiments of the subject invention.

With reference now to FIGS. 4*a* and 4*b*, another embodiment is contemplated wherein holes 36, 36' may be fashioned having an oval or slotted cross section. As such, the holes 36*a*, 36*a'* include a major and a minor axis. The major axis may be substantially collinear with respect to the channel 38. That is to say that the longitudinal axis of the holes 36*a*, 36*a'* may substantially coincide with the longitudinal axis of the channel 38. However, any angular orientation of the slotted holes 36*a*, 36*a'* with respect to the channel 38 may be utilized without departing from the intended scope of coverage of the embodiments of the subject invention. This may be useful for holding the wire 4 in place without breaking, damaging or excessively deforming the wire 4. A transition edge 39 is defined as the surface between the channel 38 and the holes 36*a*, 36*a'*. The transition edge 39 may be rounded providing a smooth surface over which the wire 4 may traverse. It is to be understood that the transition edge 39 may be rounded to any radius as is appropriate for use the embodiments of the subject invention.

With continued reference to FIGS. 1 through 5, operation of the retaining member 35 will now be discussed. Wire 4, or other contiguously formed material, may be initially secured to the barrel 7. Subsequently, the wire 4 may be wound on to the spool 1 moving back and forth laterally across the outer surface 9. In one embodiment, the wire 4, which may be welding wire 4', may be wound onto the spool 1 off-line. By off-line it is meant that the welding wire 4' is loaded onto the spool 1 at a time subsequent to the wire manufacturing process. This allows the welding wire 4' to cool down before it is wound onto the spool 1. In this manner, heat from the welding wire 4' may not adversely affect or warp the spool 1. The wire 4 may then be wound onto the spool 1 until a predetermined amount or weight of the wire 4 has been reached leaving a free end of the wire 4 proximate to the retaining member 35. The free end of the wire 4 may then be inserted into the first hole, routed through the channel 38 and back out through the second hole. In this way, the friction of the wire 4 contacting the surface of the channel 38 will effectively hold the free end of the wire 4 in place.

With reference again to FIG. 2, during the initial winding process, an empty spool 1 may be placed onto the axial support member of a wire winding machine or other apparatus, not shown, for rotation about a centerline axis of the tubular member 13. Initially, a first end of the wire 4 may be secured to the barrel 7 via a securing member 51, which may be connected with respect to the outer surface 9 of the barrel 7. In this manner, the securing member 51 may be juxtaposed to an opening 52 fashioned in the barrel 7, which may be D-shaped. Although any configuration of opening 52 may be incorporated. As previously mentioned, the wire 4 may then be wound onto the spool 1, for example, off-line or subsequent to the wire 4 manufacturing process thereby allowing the wire 4 to cool before it is wound onto the spool 1. However, other embodiments are contemplated where the wire 4 is wound directly from the wire manufacturing line. The spool 1 may then be rotated drawing the wire 4 back and forth across the outer surface 9 of the barrel 7 until a predetermined amount of wire 4 is wound onto the spool 1. The wire 4 may then be cut and inserted into the retaining member 35 thus preventing the wire 4 from unraveling as previously described.

The spool 1 may be constructed having one or more cavities or openings 43 for use by the wire winding machine. The one or more openings 43 may include holes 43' or slots 43" that can be used to determine, for example, angular position of the spool 1 and/or the amount of material present on the spool 1. A first opening 43 may be fashioned in the flange 20 and at a radial position spaced angularly apart from the securing member 51, which may represent a starting point of the coiled wire 4. The first opening 43 may be used by sensors to control certain aspects of the winding process. For example, data from the sensors may be used to sense how fast the spool 1 is rotating. Additionally, the data from the sensors may be used to approximate how much material has been wound onto the spool 1. In this manner, for clockwise rotation the first opening 43 may be spaced to the left of the securing member 51. Conversely, the first opening 43 may be spaced to the right of the securing member 51 for counterclockwise rotation. However, persons of ordinary skill in the art will readily understand that the one or more openings 43 may be disposed at any position, radially or angularly. The sensors, which may be incorporated into the wire winding machine, may be configured to detect when the first opening 43 passes by the sensor. Any manner of detecting the first opening 43 and/or any type of sensor may be utilized. It is also noted that the data from the sensors may be used to control any aspect of the winding process without departing from the intended scope of coverage. In one embodiment, the one or more openings 43 may be outlined by a rim of material 46 having a characteristic thickness t. The thickness t of the rim of material 46 may be similar to the thickness of the ribs 30. Alternatively, the thickness t of the rim of material 46 may also be substantially the same as the outer flange rim portion 33. However, it is to be understood that any thickness t may be chosen as is appropriate for use with the sensors and the speed at which the spool 1 is rotated during the winding process. The rim of material 46 may also be substantially uniform and generally planar across an upper surface of the rim of material 46. In this manner, sensors incorporated into the wire winding machine, which may be angled with respect to a centerline axis of the spool 1, may have a consistent surface to properly detect the one or more openings 43.

Figure 6:
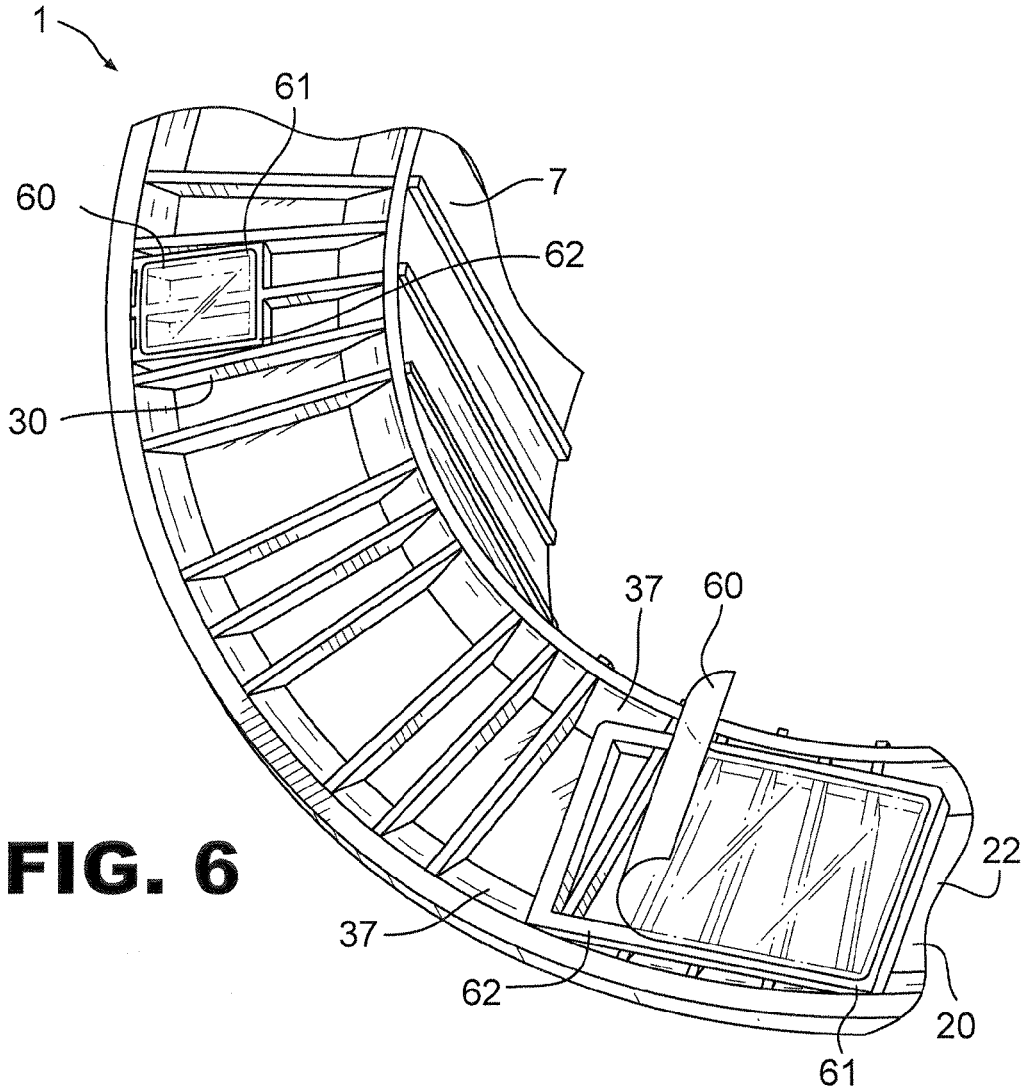
FIG. 6 is a close-up cutaway view of a second portion of the spool according to the embodiments of the subject invention.

With reference now to FIG. 6, it may be necessary to identify the kind of material that is stored on the spool 1 when distributing certain types of products. For welding products, like welding wire 4' for example, one or more labels 60 may be applied to the spool 1 for identification purposes. The labels 60 may include product labels, warning labels, usage or handling labels, and the like. The one or more labels 60 may be applied to the outer flange face 22 of the spool 1 making them conspicuously visible to the operator. In one embodiment, the outer flange face 22 may include a label platform 61 or label base 61, which may be integrally fashioned therewith. The label platform 61 may comprise a ledge 62 that outlines or corresponds to the circumference of the one or more labels 60. Other embodiments are contemplated where the label platform 61 encompasses an area that covers the entire surface area delineated by an associated label 60. The area may extend beyond the boundaries of the label 60. In this manner, the circumference of the label platform 61 may be slightly larger than the circumference of the particular label 60, which may be helpful in preventing the one or more labels 60 from detaching from the spool 1 by providing a contiguously formed and uniform surface onto which the label 60 may be affixed. The label platform 61 may have substantially the same height as the ribs 30, mentioned above. However, other embodiments are contemplated where the label platform 61 may be raised or recessed with respect to the surface of the ribs 30. It should be construed that any number of label platforms 61 may be incorporated into the outer flange face 22 as may be needed to convey information to an end user about the material wound on the spool 1. It is also noted that the size of the label platforms 61 may vary from one label platform 61 to the next. Still, any quantity and/or size of label platforms 61 may be included as is appropriate for use with the embodiments of the subject invention.

Figure 7:
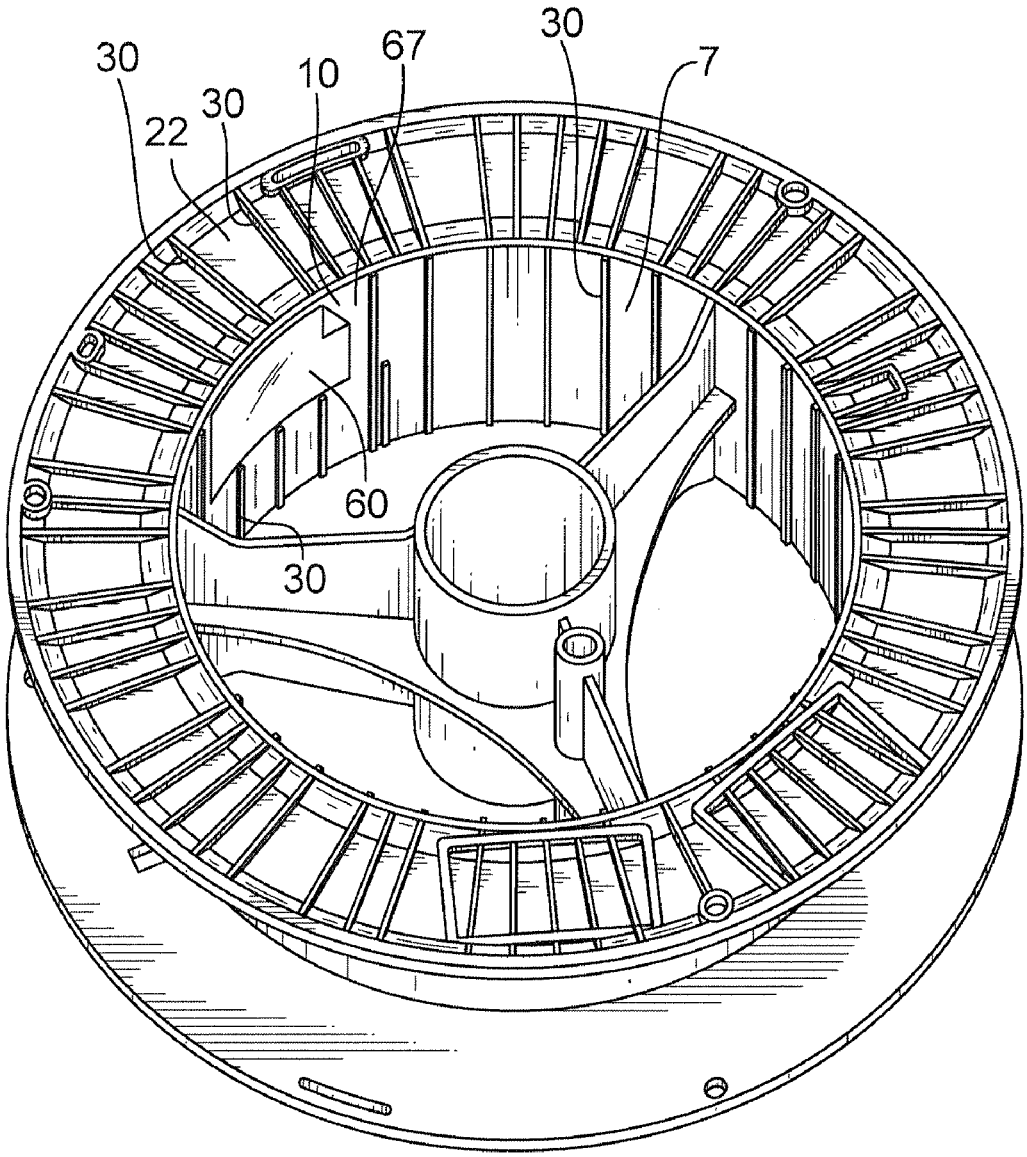
FIG. 7 is a perspective view of a spool according to the embodiments of the subject invention.

FIG. 7 depicts ribs 30 that extend from the outer flange face 22. The ribs 30 may wrap around onto the inner surface 10 of the barrel 7. In this case, to further demarcate an area for receiving labels 60, the inner surface 10 of the barrel 7 may include a region 67 devoid of the ribs 30 thereby providing a generally planar surface on which a label 60 may be placed. The inner surface 10 may include multiple planar regions 67 for accommodating multiple labels 60 applied to the spool 1. In one embodiment, the regions 67 may be disposed on opposite sides of the inner surface 10 of the barrel 7. However, any quantity, size and position of the regions 67 may be chosen as is appropriate for use with the embodiments of the subject invention.

The invention has been described herein with reference to the preferred embodiment. Obviously, modifications and alterations will occur to others upon a reading and understanding of this specification. It is intended to include all such modifications and alternations in so far as they come within the scope of the appended claims or the equivalence thereof.

The invention claimed is:

1. A spool for retaining wire, comprising:

a barrel having an outer face for receiving associated wire; and, at least a first flange having a continuously formed inner flange face extending transversely from the barrel for retaining associated wire on the outer face of the barrel, wherein the at least a first flange includes first and second holes formed in the continuously formed inner flange face, each hole having a wall through the flange forming a circumference separate from the circumference of the other hole, and a curved channel formed within the at least a first flange and connecting the first and second holes for circuitously routing an end of the associated wire, and a continuous rim formed on the first flange defining a circumference around the curved channel and the first and second holes for shielding wire routed through the curved channel.

2. The spool as defined in claim 1, wherein the curved channel is concave with respect to a plane perpendicular to the outer face of the barrel.

3. The spool as defined in claim 1, wherein the first and second holes formed in the inner flange face are slightly larger than a diameter of the associated wire.

4. The spool as defined in claim 3, wherein a centerline axis of the first hole forms an acute angle with the surface of the inner flange face.

5. The spool as defined in claim 4, wherein the acute angle is substantially in the range between 5° and 85°.

6. The spool as defined in claim 4, wherein the acute angle is substantially 25°.

7. The spool as defined in claim 1, wherein the at least a first flange has a thickness T, and, wherein the diameter of the first and second hole are smaller than the thickness T of the at least a first flange.

8. The spool as defined in claim 1, wherein the curved channel is formed in an outer flange face of the at least a first flange, and, wherein when the associated wire is routed through the curved channel, the wire does not extend beyond the outer flange face.

9. The spool as defined in claim 1, wherein the associated wire is welding wire.

10. A spool for retaining wire, comprising:

a barrel having an outer surface for receiving wire;

first and second flanges extending transversely from distal ends of the barrel and extending radially outward with respect to the outer surface of the barrel thereby forming a U-shaped wire retaining channel, the first and second flanges each having outwardly facing flange surfaces and inwardly facing flange surfaces, wherein the first flange includes a wire receiving channel formed in the outwardly facing flange surface and terminating on the inwardly facing flange surface at first and second holes, the first hole discontinuous from the second hole, wherein the wire receiving channel is arcuately shaped and contiguously formed between the first and second holes for preventing unintentional unraveling of the wire, wherein the first and second holes form angled ingress and egress pathways for the wire, the centerline axis substantially parallel to the walls of the hole of each of the first and second holes forming an acute angle with the inwardly facing flange surface, and wherein the angles between the centerline axes of the first hole and the inwardly facing surface and second hole and the inwardly facing flange surface are substantially equal in magnitude but opposite in direction with respect to inwardly facing flange surface; and, a continuous raised rim formed on the outwardly facing flange surface of the first flange defining a circumference around the wire receiving channel and the first and second holes for shielding wire routed through the wire receiving channel.

11. The spool as defined in claim 10, wherein the first flange extends radially outward from the barrel defining a first radius proximal to the outer surface of the barrel to a second circumferential radius of the first flange, and wherein the inwardly facing flange surface is contiguously formed from the first radius to the second.

12. The spool as defined in claim 11, wherein the diameter of the first and second holes is only slightly larger than the diameter of the wire.

13. The spool as defined in claim 11, wherein the first flange has a thickness (T), and wherein the diameter of the first and second hole are smaller than the thickness (T) of the first flange.

14. The spool as defined in claim 10, wherein the first and second holes are through holes formed in the first flange; and further comprising:

a rounded transition region formed between the first hole and the wire receiving channel thereby providing a smooth surface for receiving the wire.

15. The spool as defined in claim 10, wherein the acute angles between the centerline axes of the ingress and egress pathways and the inwardly facing flange surface are in a range between 5 degrees and 85 degrees.

16. The spool as defined in claim 10, wherein the acute angles between the centerline axes of the ingress and egress pathways and the inwardly facing flange surface are substantially 25 degrees.

17. The spool as defined in claim 10, wherein the first hole is formed at a first radius with respect to a centerline of the first flange and the second hole is formed at a second radius with respect to the centerline of the first flange, and, wherein the first radius is substantially different from the second radius.

18. A spool for retaining wire, comprising:

a barrel having an outer surface for receiving wire;

first and second flanges extending transversely from distal ends of the barrel and extending radially outward with respect to the outer surface of the barrel thereby forming a U-shaped wire retaining channel, the first and second flanges each having outwardly facing flange surfaces and inwardly facing flange surfaces, wherein the first flange includes a wire receiving channel formed in the outwardly facing flange surface and terminating on the inwardly facing flange surface at first and second holes, the first hole discontinuous from the second hole, wherein the wire receiving channel is arcuately shaped and contiguously formed between the first and second holes for preventing unintentional unraveling of the wire, wherein the first and second holes form angled ingress and egress pathways for the wire, the centerline axis substantially parallel to the walls of the hole of each of the first and second holes forming an acute angle with the inwardly facing flange surface;

wherein the diameter of the first and second holes are smaller than a thickness (T) of the first flange, and wherein a depth of the channel is smaller than the thickness (T) of the first flange; and, a continuous raised rim formed on the outwardly facing flange surface of the first flange defining a circumference around the wire receiving channel and the first and second holes for shielding wire routed through the wire receiving channel.

* * * * *